US007504134B2

(12) United States Patent
Woltering

(10) Patent No.: US 7,504,134 B2
(45) Date of Patent: Mar. 17, 2009

(54) METHOD FOR PRODUCING COLOR AND/OR EFFECT-PRODUCING MULTILAYER PAINTS ON CAR BODIES

(75) Inventor: Joachim Woltering, Münster (DE)

(73) Assignee: BASF Coatings AG, Munster (DE)

( * ) Notice: Subject to any disclaimer, the term of this patent is extended or adjusted under 35 U.S.C. 154(b) by 236 days.

(21) Appl. No.: 10/181,793

(22) PCT Filed: Feb. 1, 2001

(86) PCT No.: PCT/EP01/01081

§ 371 (c)(1),
(2), (4) Date: Jul. 17, 2002

(87) PCT Pub. No.: WO01/62401

PCT Pub. Date: Aug. 30, 2001

(65) Prior Publication Data

US 2003/0108681 A1 Jun. 12, 2003

(30) Foreign Application Priority Data

Feb. 25, 2000 (DE) ..... 100 08 946

(51) Int. Cl.
*B05D 1/04* (2006.01)

(52) U.S. Cl. ..... 427/470; 427/484; 427/486

(58) Field of Classification Search ..... 427/470, 427/480, 483, 484, 485, 486, 553
See application file for complete search history.

(56) References Cited

U.S. PATENT DOCUMENTS

| | | | | |
|---|---|---|---|---|
| 4,268,542 | A | 5/1981 | Sakakibara et al. | 427/195 |
| 4,375,498 | A | 3/1983 | Le Minez et al. | 428/416 |
| 4,419,467 | A | 12/1983 | Wismar et al. | 523/414 |
| 4,450,200 | A * | 5/1984 | Iwato et al. | 428/323 |
| 4,455,965 | A * | 6/1984 | Jung et al. | 118/622 |
| 4,489,135 | A | 12/1984 | Drexler et al. | 428/423.1 |
| 4,537,926 | A | 8/1985 | Kivel et al. | 524/388 |
| 4,614,683 | A | 9/1986 | Barsolti | 428/220 |
| 4,615,779 | A | 10/1986 | McCollum et al. | 204/181.7 |
| 4,761,212 | A | 8/1988 | Watanabe et al. | 204/181.1 |
| 4,851,460 | A | 7/1989 | Stanghöner et al. | 523/407 |
| 4,880,867 | A | 11/1989 | Gobel et al. | 524/507 |
| 4,914,148 | A | 4/1990 | Hille et al. | 524/507 |
| 4,945,128 | A | 7/1990 | Hille et al. | 524/591 |
| 5,075,372 | A | 12/1991 | Hille et al. | 524/839 |
| 5,210,154 | A | 5/1993 | Weidemeier et al. | 525/438 |
| 5,229,210 | A | 7/1993 | Kasukawa et al. | 428/416 |
| 5,324,404 | A | 6/1994 | Ott et al. | 204/181.7 |
| 5,334,420 | A | 8/1994 | Hartung et al. | 427/407.1 |
| 5,342,882 | A | 8/1994 | Göbel et al. | 524/832 |
| 5,368,944 | A | 11/1994 | Hartung et al. | 428/423.1 |
| 5,370,910 | A | 12/1994 | Hille et al. | 427/407.1 |
| 5,376,457 | A | 12/1994 | Smith | 428/457 |
| 5,385,656 | A | 1/1995 | Doebler et al. | 204/181.1 |
| 5,389,406 | A | 2/1995 | Doebler et al. | 427/407.1 |
| 5,425,970 | A * | 6/1995 | Lahrmann et al. | 427/493 |
| 5,507,928 | A | 4/1996 | Böhmert et al. | 204/488 |
| 5,569,705 | A | 10/1996 | Vogt-Birnbrich et al. | 524/591 |
| 5,571,861 | A | 11/1996 | Klein et al. | 524/591 |
| 5,601,880 | A | 2/1997 | Schwarte et al. | 427/407.1 |
| 5,654,391 | A | 8/1997 | Göbel et al. | 528/71 |
| 5,691,425 | A | 11/1997 | Klein et al. | 525/455 |
| 5,760,128 | A | 6/1998 | Baltus et al. | 524/591 |
| 5,869,198 | A * | 2/1999 | Erne et al. | 428/626 |
| 5,905,132 | A | 5/1999 | Wegner et al. | 528/45 |
| 5,965,213 | A * | 10/1999 | Sacharski et al. | 427/475 |
| 5,981,653 | A | 11/1999 | Wilmes et al. | 524/839 |
| 6,001,424 | A | 12/1999 | Lettmann et al. | 427/407.1 |
| 6,177,487 | B1 | 1/2001 | Sapper et al. | 523/333 |
| 6,201,043 | B1 | 3/2001 | Bremser et al. | 523/407 |
| 6,221,949 | B1 | 4/2001 | Gross et al. | 524/451 |
| 6,291,579 | B1 | 9/2001 | Kalck et al. | 524/832 |
| 6,372,875 | B1 | 4/2002 | Mayer et al. | 528/60 |

FOREIGN PATENT DOCUMENTS

| | | |
|---|---|---|
| CA | 2073115 | 3/1992 |
| CA | 2078650 | 10/1992 |
| CA | 2104845 | 8/1993 |
| CA | 2102169 | 11/1993 |
| CA | 2102170 | 11/1993 |
| CA | 2127761 | 7/1994 |

(Continued)

OTHER PUBLICATIONS

Powder Coating The Complete Finisher's Handbook. Ed by N.P. Liberto, p. 99 1994.*

(Continued)

*Primary Examiner*—Frederick J Parker
(74) *Attorney, Agent, or Firm*—Cantor Colburn LLP

(57) ABSTRACT

Disclosed is a process for producing multicoat color and/or effect paint systems on automobile bodies. The disclosed process includes applying an aqueous base coat material to the body and drying or partially curing the resultant aqueous basecoat film, applying an aqueous powder slurry clearcoat material to the dried or partially cured aqueous basecoat film (I), and curing the films (I) and (II) by heat or by heat and actinic radiation (dual cure). Applying the aqueous powder slurry clearcoat material (II) involves electrostatic coating of the exterior body parts, followed by pneumatic spraying (compressed air spraying) of the interior body parts.

20 Claims, No Drawings

FOREIGN PATENT DOCUMENTS

| | | | |
|---|---|---|---|
| CA | 2213833 | | 3/1996 |
| CA | 2073814 | | 10/1999 |
| EP | 299 148 | | 4/1988 |
| EP | 354 261 | | 8/1988 |
| EP | 394 737 | | 4/1990 |
| EP | 401 565 | | 5/1990 |
| EP | 424 705 | | 10/1990 |
| EP | 531 510 | | 3/1992 |
| EP | 531 510 | * | 10/1992 |
| EP | 590 484 | | 9/1993 |
| EP | 652 264 | | 10/1994 |
| WO | WO97/49745 | | 12/1997 |
| WO | WO97/49747 | | 12/1997 |

OTHER PUBLICATIONS

"Powder Coating The Complete Finisher's Handbook", N.P. Liberto, ed. pp. 99-100, 1994.*
English Abstract for DE4328092.
English Abstract for WO96/12747 on front page of the International Publication.
English Abstract for EP297 576.
English Abstract for DE 19618657.
English Abstract for EP698 069.

* cited by examiner

METHOD FOR PRODUCING COLOR AND/OR EFFECT-PRODUCING MULTILAYER PAINTS ON CAR BODIES

TECHNICAL FIELD

The present invention relates to a novel process for producing multicoat color and/or effect paint systems on automobile bodies which uses a powder slurry clearcoat material.

BACKGROUND

In automotive OEM finishing, the interior parts of the automobile bodies are normally first painted by pneumatic spraying or compressed air spraying. Pneumatic spraying is selected because the cavities and recesses are difficult to coat electrostatically, owing to the formation of Faraday cages.

For the painting of the interior, the doors are opened and, by hand or using an automatic painting device, the rabbets and the insides of the doors are painted. This, however, produces a spray mist which falls onto the outside of the body. The area around the doors and the hood are particularly affected by this phenomenon. When powder clearcoat slurries are used, this spray mist dries particularly rapidly and, in the course of subsequent electrostatic coating of the exterior parts of the body, it is only covered by, rather than being taken up again into, the powder clearcoat slurry employed for said exterior coating. At those points where the spray mist landed, therefore, after baking there are elevations or leveling defects which become visible at a size of more than 0.5 μm. Since, moreover, these elevations or leveling defects are present on regions of the body which are particularly easy to see, they are especially evident and give rise to the impression that the product as a whole is of inadequate quality.

These effects are not so pronounced with solventborne clearcoat materials, since these materials have higher solids contents, so that the difference between the solids content of the wet paint and the solids content of the spray mist is lower than in the case of the powder slurry clearcoat materials. Moreover, the solventborne clearcoat materials have a lower viscosity and, consequently, they spread more effectively. As a result, the spray mist too becomes flatter. Not least, because of the presence therein of high-boiling organic solvents ("long solvents") they do not dry so rapidly and can therefore be taken up much more effectively by clearcoat materials applied over them.

It is an object of the present invention find a novel process for producing multicoat color and/or effect paint systems on automobile bodies which no longer has the disadvantages of the prior art but instead, even when using powder slurry clearcoat materials, gives paint systems which no longer exhibit any visible elevations or leveling defects.

SUMMARY

The invention accordingly provides the novel process for producing multicoat color and/or effect paint systems on automobile bodies by (I) applying an aqueous base coat material to the body and drying or partially curing the resultant aqueous basecoat film, (II) applying an aqueous powder slurry clearcoat material to the dried or partially cured aqueous basecoat film (II), and (III) curing the films (I) and (II) by heat or by heat and actinic radiation (dual cure), which involves applying the aqueous powder slurry clearcoat material (II) by (IIa) electrostatic coating of the exterior body parts, followed by (IIb) pneumatic spraying (compressed air spraying) of the interior body parts.

DETAILED DESCRIPTION OF EXEMPLARY EMBODIMENTS OF THE PRESENT INVENTION

The novel process for producing multicoat color and/or effect paint systems on automobile bodies is referred to below as "process of the invention".

The novel process surprisingly has the effect that wet powder slurry clearcoat films, present on the outside of the automobile body and applied by electrostatic coating, are able without problems to take up the spray mist drops from the interior coating, thereby achieving substantially improved leveling.

The automobile bodies used in connection with the process of the invention normally have a cathodically deposited and thermally cured electrocoat. However, they may also have a cathodically deposited electrocoat film which is not cured thermally but is instead only dried or partially cured. The electrocoat or electrocoat film is then overcoated with a surfacer, which is cured either alone or together with the electrocoat film (wet-on-wet technique). Overcoating with a surfacer is carried out in particular in those areas which are subject to severe mechanical stress, such as by stone chipping, for example.

Examples of suitable cathodic electrocoat materials and also, where appropriate, of wet-on-wet techniques are described in Japanese patent application 1975-142501 (Japanese laid-open specification JP 52-065534 A2, chemical abstracts No. 87: 137427) or in patents U.S. Pat. No. 4,375,498 A1, U.S. Pat. No. 4,537,926 A1, U.S. Pat. No. 4,761,212 A1, EP-0 529 335 A1, DE 41 25 459 A1, EP 0 595 186 A1, EP-0 974 634 A1, EP-0-505 445 A1, DE 42 35 778 A1, EP 0 646 420 A1, EP 0 639 660 A1, EP 0 817 648 A1, DE 195 12 017 C1, EP 0 192 113 A2, DE 41 26 476 A1 or WO 90/07794.

Similarly, suitable surfacers, especially aqueous surfacers, which are also referred to as antistonechip primers or functional coatings, are described, for example, in patents U.S. Pat. No. 4,537,926 A1, EP 0 529 335 A1, EP 0 595 186 A1, EP 0 639 660 A1, DE 44 38 504 A1, DE 43 37 961 A1, WO 89/10387, DE 4,450,200 A1, U.S. Pat. No. 4,614,683 A1 or WO 94/26827.

Alternatively, these surfaces may be applied to the baked electrocoats and then predried or partially thermally cured. In the case of this variant of the process of the invention, they are then cured together with the aqueous basecoat films and powder slurry clearcoat films that are applied to the surfacer film (extended wet-on-wet techniques).

In the interior of the automobile body there is no need for the surfacer coat or antistonechip primer coat, since here there is generally no risk of mechanical stress.

In the subsequent course of the process of the invention, the surfacer coats are coated with aqueous basecoat materials. Examples of suitable aqueous basecoat materials, especially polyurethane-based aqueous basecoat materials are known from patents EP 0 089 497 A1, EP 0 256 540 A1, EP 0 260 447 A1, EP 0 297 576 A1, WO 96/12747, EP 0 523 610 A1, EP 0 228 003 A1, EP 0 397 806 A1, EP 0 574 417 A1, EP 0 531 510 A1, EP 0 581 211 A1, EP 0 700 780 A1, EP 0 593 454 A1, DE-A-43 28 092 A1, EP 0 299 148 A1, EP 0 394 737 A1, EP 0 590 484 A1, EP 0 234 362 A1, EP 0 234 361 A1, EP 0 543

817 A1, WO 95/14721, EP 0 521 928 A1, EP 0 522 420 A1, EP 0 522 419 A1, EP 0 649 865 A1, EP 0 536 712 A1, EP 0 596 460 A1, EP 0 596 461 A1, EP 0 584 818 A1, EP 0 669 356 A1, EP 0 634 431 A1, EP 0 678 536 A1, EP 0 354 361 A1, EP 0 424 705 A1, WO 97/49745, WO 97/49747, EP 0 401 568 A1 or EP 0 817 684, column 5, lines 31 to 45.

Normally, the resultant aqueous basecoat films are not cured but instead are predried or partially cured.

The aqueous powder slurry clearcoat materials are applied over the aqueous basecoat films to give powder slurry clearcoat films. Examples of suitable powder slurry clearcoat materials are known from the U.S. Pat. No. 4,268,542 and from patent applications DE 195 40 977 A1, DE 195 18 392 A1, DE 196 17 086 A1, DE-A-196 13 547, EP 0 652 264 A1, DE 196 18 657 A1, DE 196 52 813 A1, DE 196 17 086 A1 or DE-A-198 14 471 A1.

In a procedure according to the invention, the aqueous powder slurry clearcoat materials are applied by electrostatic coating of the exterior body parts, followed by pneumatic spraying (compressed air spraying) of the interior body parts.

Electrostatic coating here can be carried out by means of an electrostatic spraying slot, an electrostatic spraying bell or an electrostatic spraying disk.

Furthermore, electrostatic coating may be carried out by means of electrostatically assisted mechanical atomization. This is preferably carried out by means of electrostatic high-speed rotating disks or high-speed rotating bells.

The pneumatic spraying or compressed air painting also has no special features as far as its method is concerned but instead can be carried out by hand or using customary and known automatic painting devices or painting robots.

For further details of these terms, refer to Rŏmpp Lexikon Lacke und Druckfarben, Georg Thieme Verlag, Stuttgart, New York, 1998, page 186: "electrostatic coating", page 187: "electrostatic spray guns", "electrostatic spraying", and page 165: "compressed air spraying".

Of course, in the context of the process of the invention, these application methods may also be employed for producing the other coating films, except for the cathodically depositable electrocoat film.

Application is preferably made under illumination with visible light with a wavelength of more than 550 μm or in the absence of light if the aqueous basecoat material and/or the powder slurry clearcoat materials are curable thermally and with actinic radiation. This prevents material damage or change in the coating material for use in accordance with the invention, and its overspray.

The coating materials for use in accordance with the invention are generally applied in a wet film thickness such that curing thereof results in coatings having the thicknesses which are advantageous and necessary for their functions. In the case of a base coat those thicknesses are from 5 to 50 μm, preferably from 5 to 40 μm, with particular preference from 5 to 30 μm, and in particular from 10 to 25 μm, and in the case of a clearcoat they are from 10 to 100 μm, preferably from 15 to 80 μm, with particular preference from 20 to 75 μm, and in particular from 25 to 70 μm.

Following application, the aqueous basecoat films are cured together with the powder slurry clearcoat films and, where appropriate, the underlying coating films which have not been cured, or have not been fully cured, the curing taking place thermally or both thermally and with actinic radiation. Curing with heat and with actinic radiation in also referred to by those in the art as dual cure. For the purposes of the present invention, actinic radiation means electromagnetic radiation such as near infrared (NIR), visible light, UV light or X-rays, but especially UV light, or corpuscular radiation such as electron beams.

Curing may take place after a certain rest time or flashoff time. It may have a duration of from 30 seconds to 2 hours, preferably from 1 minute to 1 hour, and in particular from 1 minute to 45 minutes. The rest time is used, for example for leveling and devolatilization of the films and for the evaporation of volatile constituents such as any water and/or solvent that may still be present.

For curing with actinic radiation it is preferred to employ a dose of from 1000 to 2000, preferably from 1100 to 1900, with particular preference from 1200 to 1800, with very particular preference from 1300 to 1700, and in particular from 1400 to 1600 mJ/cm$^2$. Where appropriate, this curing may be supplemented with actinic radiation from other sources. In the case of electron beams it is preferred to operate under an inert gas atmosphere. This can be ensured, for example, by supplying carbon dioxide and/or nitrogen directly to the surface of the clearcoat film. In the case of curing with UV radiation as well it is possible to operate under inert gas in order to prevent the formation of ozone.

Curing with actinic radiation is carried out using the customary and known radiation sources and optical auxiliary measure. Examples of suitable radiation sources are flash lamps, high or low pressure mercury vapor lamps which may have been doped with lead in order to open up a radiation window up to 405 nm, or electron beam sources. The arrangement of these sources is known in principle and may be adapted to the circumstances of the workpiece and the process parameters. In the case of workpieces of complex shape, such as are envisaged for automobile bodies, those regions not accessible to direct radiation (shadow regions) such as cavities, folds and other structural undercuts may be (partly) cured using pointwise, small-area or all-round emitters in conjunction with an automatic movement means for the irradiation of cavities or edges.

The equipment and conditions for these curing methods are described in, for example, R. Holmes, U.V. and E.B. Curing Formulations for Printing Inks, Coatings and Paints, SITA Technology, Academic Press, London, United Kingdom 1984.

The cure here may also be effected in stages, i.e., by multiple exposure to light or actinic radiation. It may also take place alternatingly, i.e., by curing alternately with UV radiation and electron beams.

Thermal curing as well has no special features as far as its method is concerned and instead takes place in accordance with the customary and known methods such as heating in a forced air oven or irradiation with IR and/or NIR lamps. As in the case of curing with actinic radiation, thermal curing may also be carried out in stages. Thermal curing takes place advantageously at temperatures from 90° C. to 180° C.

In the case of dual cure, thermal curing and curing with actinic radiation may be employed simultaneously or successively. Where the two curing methods are used successively, it is possible, for example, to begin with the thermal cure and to end with the actinic radiation cure. In other cases it may prove advantageous to begin and to end with the actinic radiation cure.

Of course, the curing methods described above may also be employed for curing the other coating films within the context of the process of the invention.

The multicoat color and/or effect paint system resulting from the process of the invention may also be coated with a coat of an organically modified ceramic material, such as is available commercially, for example, under the brand name Ormocer®.

The multicoat color and/or effect paint systems produced in a procedure in accordance with the invention are of particularly high gloss. In comparison to the multicoat paint systems produced conventionally, they have significantly less haze and very few if any disruptive surface structures such as orange peel structures. They are therefore of particularly high optical quality. Since the other advantages of aqueous base coats and powder slurry clearcoats are retained in their entirety, they are of particularly high technical and economic value for users and their customers.

INVENTIVE AND COMPARATIVE EXAMPLES

For the comparative example, the spray mist of a customary and known powder slurry clearcoat material was applied to the surface of test panels which had been coated with a black base coat and was flashed off at room temperature for two minutes. The powder slurry clearcoat material was then applied in wedge form over the spray mist droplets and flashed off at room temperature for two minutes. Thereafter, spray mist droplets and powder slurry clearcoat wedge were predried at 40° C. for 10 minutes and then baked at 150° C. for 30 minutes.

For the inventive example, the comparative example was repeated except that first of all the powder slurry clearcoat material was applied in wedge form and then the spray mist was applied.

The waviness of the powder slurry clearcoats of the inventive and comparative examples were measured using the wavescan method. For this purpose, a laser beam was directed onto the surface at an angle of 60° and the fluctuations in the reflected light in the so-called longwave region (0.6 to 10 mm; observation distance: 2.5 m) and in the so-called shortwave region (0.1 to 0.6 nm; observation distance: 45 cm) were recorded over a length of 10 cm using a measuring instrument.

The glass and haze were measured by reflectometry at an angle of 20° using a BYK reflectometer in accordance with DIN 67530: 1982-01 or ISO 2813: 1994.

The results are given in table 1 (comparative example) and table 2 (inventive example). A comparison of the results shows that the process of the invention gave powder slurry clearcoats having significantly better optical properties and surface properties.

TABLE 1

Gloss, haze, and waviness of powder slurry clearcoats produced in conventional manner (comparative example)

| | | | Waviness: | |
|---|---|---|---|---|
| Mist/wedge (μm) | Gloss | Haze | longwave | shortwave |
| 30 | 76.0 | 50.4 | 46.0 | 54.3 |
| 40 | 77.0 | 33.6 | 35.2 | 34.3 |
| 50 | 77.1 | 28.3 | 16.3 | 17.5 |

TABLE 2

Gloss, haze, and waviness of powder slurry clearcoats produced in inventive manner (inventive example)

| | | | Waviness: | |
|---|---|---|---|---|
| Mist/wedge (μm) | Gloss | Haze | longwave | shortwave |
| 30 | 77.4 | 32.6 | 22.5 | 33.1 |
| 40 | 78.0 | 27.1 | 9.9 | 15.1 |
| 50 | 77.7 | 27.6 | 6.9 | 15.3 |

What is claimed is:

1. A process for producing multicoat paint system on an automobile body comprising exterior and interior body parts, the process comprising applying an aqueous base coat material to the body to provide a basecoat film (I), applying an aqueous powder slurry clearcoat material to the basecoat film (I) to provide a clearcoat film (II), and curing the films (I) and (II) by a curing mechanism comprising heat, wherein applying the aqueous powder slurry clearcoat material (II) comprises electrostatically coating exterior body parts, followed by pneumatic spraying of interior body parts.

2. The process of claim 1, wherein electrostatic coating is carried out by means selected from the group consisting of an electrostatic spraying slot, an electrostatic spraying bell and an electrostatic spraying disk.

3. The process of claim 1, wherein electrostatic coating is carried out by means of electrostatically assisted mechanical atomization.

4. The process of claim 3, wherein electrostatically assisted mechanical atomization uses at least one of electrostatic high-speed rotating disks or high-speed rotating bells.

5. The process of claim 1, wherein prior to the application of the aqueous basecoat material a surfacer is applied to the body.

6. The process of claim 5, wherein an aqueous surfacer is used.

7. The process of claim 1, wherein a polyurethane-based aqueous basecoat material is used.

8. The process of claim 5, wherein the body is coated with a carthodically deposited electrocoat material before the application of the surfacer and is then baked together with the surfacer film.

9. The process of claim 1 further comprising drying the basecoat film (I) before the aqueous powder slurry clearcoat material is applied.

10. The process of claim 9 further comprising partially curing the aqueous basecoat film (I) before the aqueous powder slurry clearcoat material is applied.

11. The process of claim 1 wherein the curing mechanism further comprises actinic radiation.

12. The process of claim 5, wherein the applied surfacer is dried prior to the application of the aqueous basecoat material.

13. The process of claim 12, wherein the applied surfacer is partially cured prior to the application of the aqueous basecoat material.

14. The process of claim 13, wherein the applied surfacer is cured prior to the application of the aqueous basecoat material.

15. The process of claim 8, wherein the cathodically deposited electrocoat material is dried before the application of the surfacer.

16. The process of claim 15, wherein the cathodically deposited electrocoat material is partially thermally cured before the application of the surfacer.

17. The process of claim 16, wherein the cathodically deposited electrocoat material is thermally cured before the application of the surfacer.

18. A process for producing multicoat paint system on an automobile body comprising exterior and interior body parts, the process comprising applying a polyurethane-based aqueous base coat material (I) to the body to provide a basecoat film (I), applying an aqueous powder slurry clearcoat material (II) to the basecoat film (I) to provide a clearcoat film (II), and curing the films (I) and (II) by a curing mechanism comprising heat, wherein applying the aqueous powder slurry clearcoat material (II) comprises electrostatically coating exterior body parts, followed by pneumatic spraying of interior body parts, wherein wet powder slurry clearcoat film, present on the outside of the automobile body and applied by electrostatic coating are able to take up spray mist drops from the pneumatic spraying of interior coating, wherein greater leveling is obtained according to a comparison to pneumatic spraying of interior body parts followed by electrostatically coating exterior body parts, as measured by wavescan.

19. The process of claim 18, wherein the longwave waviness is reduced according to the comparison.

20. The process of claim 18, wherein the shortwave waviness and the haze are reduced according to the comparison.

* * * * *